US010737494B2

(12) United States Patent
Sugiura

(10) Patent No.: US 10,737,494 B2
(45) Date of Patent: Aug. 11, 2020

(54) LIQUID JETTING APPARATUS AND LIQUID JETTING SYSTEM

(71) Applicant: Brother Kogyo Kabushiki Kaisha, Nagoya-shi, Aichi-ken (JP)

(72) Inventor: Keita Sugiura, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/271,939

(22) Filed: Feb. 11, 2019

(65) Prior Publication Data

US 2019/0299615 A1 Oct. 3, 2019

(30) Foreign Application Priority Data

Mar. 30, 2018 (JP) ..... 2018-068402

(51) Int. Cl.
*B41J 2/14* (2006.01)
*B41J 2/16* (2006.01)

(52) U.S. Cl.
CPC ..... *B41J 2/14274* (2013.01); *B41J 2/1612* (2013.01); *B41J 2/1623* (2013.01); *B41J 2/1626* (2013.01)

(58) Field of Classification Search
CPC .. B41J 2/14274; B41J 2/15612; B41J 2/1623; B41J 2/1626; B41J 2/04533; B41J 2/14056; B41J 2/14032; B41J 2/14048; B41J 2/19; B41J 2/1404; B41J 2/14145; B41J 2/14233; B41J 2/04581; B41J 2/17563; B41J 2002/14338
See application file for complete search history.

(56) References Cited

U.S. PATENT DOCUMENTS

2011/0134174 A1* 6/2011 Seto ..... B41J 2/04526
2017/0106663 A1* 4/2017 Irokawa ..... B41J 2/1433

FOREIGN PATENT DOCUMENTS

JP 2011-245795 A 12/2011

* cited by examiner

*Primary Examiner* — Juanita D Jackson
(74) *Attorney, Agent, or Firm* — Banner & Witcoff, Ltd.

(57) ABSTRACT

A liquid jetting apparatus includes: a nozzle plate having a nozzle; and a channel unit joined with the nozzle plate. The channel unit is formed with a first pressure chamber, a second pressure chamber, and a link channel linking the first pressure chamber and the second pressure chamber. In the channel unit, a dent portion is formed on an inner wall, which defines the link channel, at a part overlapping with an axis line of the nozzle. The dent portion is dented in a direction away from the nozzle.

12 Claims, 6 Drawing Sheets

LIQUID JETTING APPARATUS AND LIQUID JETTING SYSTEM

CROSS REFERENCE TO RELATED APPLICATION

The present application claims priority from Japanese Patent Application No. 2018-068402 filed on Mar. 30, 2018, the disclosures of which is incorporated herein by reference in its entirety.

BACKGROUND

Field of the Invention

The present invention relates to a liquid jetting apparatus and a liquid jetting system which jet liquid from nozzles.

Description of the Related Art

As disclosed in Japanese Patent Application Laid-open No. 2011-245795, for example, there is known a liquid jetting apparatus including two piezo elements arranged to correspond to one nozzle and configured to circulate ink in the vicinity of the nozzle.

SUMMARY

However, in the liquid jetting apparatus having the above configuration, if some air bubbles are mixed into the liquid in an individual channel such as a pressure chamber and the like, then imbalance may occur in the pressure applied to the liquid by the two piezo elements to cause an unstable operation of jetting the liquid from the nozzle.

An object of the present teaching is to prevent unstable operation of jetting liquid from a nozzle due to some air bubbles mixed into the liquid, in a liquid jetting apparatus including two pressure chambers.

According to an aspect of the present teaching, there is provided a liquid jetting apparatus including: a nozzle plate having a nozzle; and a channel unit joined with the nozzle plate, wherein the channel unit is formed with: a first pressure chamber; a second pressure chamber; and a link channel linking the first pressure chamber and the second pressure chamber, and wherein in the channel unit, a dent portion is formed on an inner wall, which defines the link channel, at a part overlapping with an axis line of the nozzle, the dent portion being dented in a direction away from the nozzle.

According to the above configuration, if some air bubbles are mixed into fluid flowing through the link channel, it is possible to detain the air bubbles in the dent portion. The dent portion is formed in the part overlapping with the axis line of the nozzle and, in the part overlapping with the axis line of the nozzle, a balance is maintained for the pressure applied to the liquid in the first pressure chamber and the second pressure chamber. By detaining the air bubbles in the dent portion overlapping with the axis line of the nozzle, it is possible to prevent unstable operation of jetting the liquid from the nozzle due to the air bubbles mixed in the liquid.

Further, the air bubbles detained in the dent portion can be discharged from the dent portion by pressurizing and meanwhile circulating the liquid, for example, when the liquid is not jetted from the nozzle. By virtue of this, it is possible to preferably remove the air bubbles mixed in the liquid from the periphery of the nozzle before carrying out the operation of jetting the liquid from the nozzle. Further, because the air bubbles need not be removed when the liquid is jetted from the nozzle, it is possible to prevent an increase in the load on the apparatus for removing the air bubbles.

According to the present teaching, it is possible to prevent unstable operation of jetting liquid from the nozzle due to some air bubbles mixed into the liquid in a liquid jetting apparatus including two pressure chambers.

DESCRIPTION OF THE EMBODIMENTS

Hereinbelow, referring to the accompanying drawings, respective embodiments of the present teaching will be explained.

First Embodiment

<Overall Configuration of a Printer>

Figure 1:
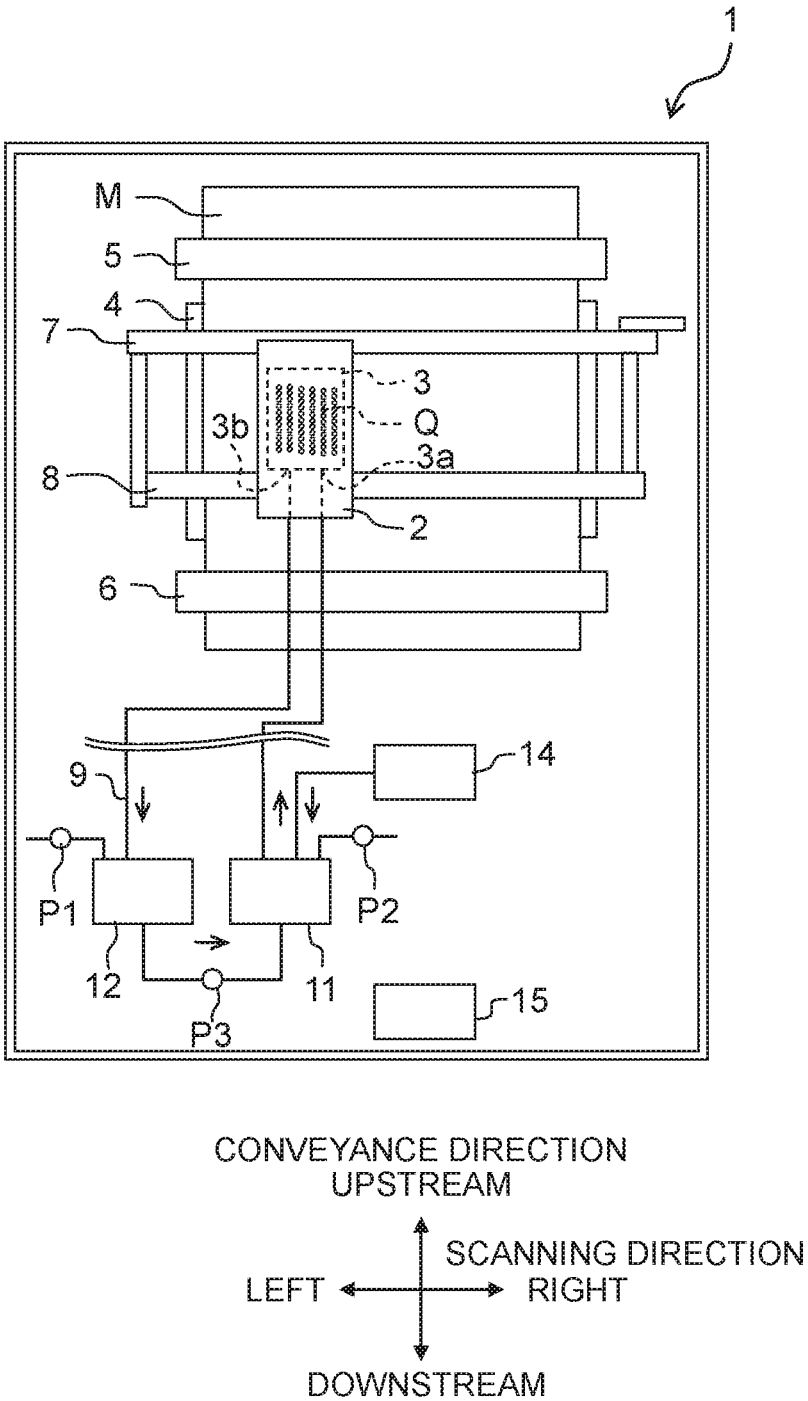
FIG. 1 is a schematic configuration diagram of a printer according to a first embodiment of the present teaching.

A printer 1 is an example of liquid jetting systems. As depicted in FIG. 1, the printer 1 includes a carriage 2, an ink jet head 3, a platen 4, conveyance rollers 5 and 6, a pressurizing tank 11, a negative pressure tank 12, air pumps P1 and P2, an ink pump P3, a tank 14, and a controller 15.

The carriage 2 is supported by two guide rails 7 and 8 extending in a scanning direction to move reciprocatingly together with the ink jet head 3 along the guide rails 7 and 8 in the predetermined scanning direction. Hereinbelow, the right side of the page of FIG. 1 is defined as the right side of the scanning direction whereas the left side of the page is defined as the left side of the scanning direction.

The ink jet head 3 is an example of liquid jetting apparatuses, and is mounted on the carriage 2. The ink jet head 3 is, as will be described later on, provided with 72 nozzles 201 to jet an ink as an example of liquids (see FIG. 2), four supply ports 3*a*, and three discharge ports 3*b*. Note that in FIG. 1, for convenience in illustration, only one supply port 3*a* and one supply port 3*b* are depicted.

The supply ports 3*a* are connected with ends of a pipe 9 at one side, while the discharge ports 3*b* are connected with ends of the pipe 9 at the other side. The pipe 9 is connected midway with the pressurizing tank 11, the negative pressure tank 12, and the ink pump P3. The pressurizing tank 11 retains the ink. The pressurizing tank 11 is connected with the air pump P2 pressurizing the ink with air, and the supply tank 14 supplying the ink to the pressurizing tank 11. The pressurizing tank 11 is connected to such a part of the pipe 9 as close to the supply ports 3*a*. With the air pump P2 raising the pressure of the air in the pressurizing tank 11, the ink in the pressurizing tank 11 is pressurized to supply the pipe 9 with the ink retained in the pressurizing tank 11.

The negative pressure tank 12 also retains the ink. The negative pressure tank 12 is connected with the air pump P1 depressurizing the ink with air. The negative pressure tank 12 is connected to such a part of the pipe 9 as close to the discharge ports 3*b*. With the air pump P1 lowering the pressure of the air in the negative pressure tank 12, part of the ink flowing through the pipe 9 is sucked up into the negative pressure tank 12.

The ink pump P3 is arranged at the pipe 9 between the tanks 11 and 12. The ink pump P3 supplies the ink to the pressurizing tank 11 from the negative pressure tank 12. In the printer 1, along with the driving of the pumps P1 to P3, the ink circulates inside the respective parts of the pipe 9 and ink jet head 3. Each of the pumps P1 to P3 causes the ink to flow in the pressure chambers 211*a* and the pressure chambers 211*b* of an aftermentioned channel unit 21.

The platen 4 is arranged to face the nozzles 201 of the ink jet head 3, and to extend in the scanning direction and in a conveyance direction orthogonal to the scanning direction. A recording sheet M is placed on the platen 4. The conveyance rollers 5 and 6 convey the recording sheet M along the conveyance direction. The conveyance roller 5 is arranged on the upstream side from the carriage 2 in the conveyance direction while the conveyance roller 6 is arranged on the downstream side from the carriage 2 in the conveyance direction.

The controller 15 controls the carriage 2, the pumps P1 to P3, the conveyance rollers 5 and 6, and piezoelectric elements 22*c* (see FIG. 4), respectively, In the printer 1, due to the control by the controller 15, each time the recording sheet M is conveyed by the conveyance rollers 5 and 6 in the conveyance direction through a predetermined distance, the carriage 2 is moved in the scanning direction while the ink is jetted from the 72 nozzles 201 of the ink jet head 3. By virtue of this, printing is carried out on the recording sheet M.

<Ink Jet Head>

As depicted in FIGS. 2 to 5, the ink jet head 3 has a nozzle plate 20, a channel unit 21, and the piezoelectric elements 22*c*. Note that in FIGS. 4 and 5, a direction perpendicular to the page of the drawings corresponds to the second direction.

The nozzle plate 20 has the nozzles 201. The nozzle plate 20 in this embodiment is formed therein with the 72 nozzles 201 penetrating therethrough in the plate-thickness direction. In the nozzle plate 20, six nozzle rows are arranged in predetermined positions at intervals in the scanning direction. Each of the nozzle rows includes 12 nozzles 201. Further, the 12 nozzles 201 of each nozzle row are aligned in the conveyance direction at predetermined intervals.

<Channel Unit>

A channel unit 21 has the surface S1 against the nozzle plate 20. The surface S1 is attached to the nozzle plate 20. The channel unit 21 is formed with the pressure chambers 211*a*, pressure chambers 211*b*, throttle channels 212*a*, throttle channels 212*b*, descender channels 213*a*, descender channels 213*b*, and channels 214, each set of which has 72 members. Further, the channel unit has 4 manifolds 215*a*, 3 manifolds 215*b*, 4 damper chambers 216*a*, and 3 damper chambers 216*a*.

The pressure chambers 211*a* and the pressure chambers 211*b* are linked through the descender channels 213*a*, the channels 214, and the descender channels 213*b*. The channels 214 connect the descender channels 213*a* and the descender channels 213*b*. In this embodiment, link channels 260 refer to the channels formed from the descender channels 213*a*, the channels 214, and the descender channels 213*b*. That is, the channel unit 21 is formed therein with the link channels 260.

Figure 4:
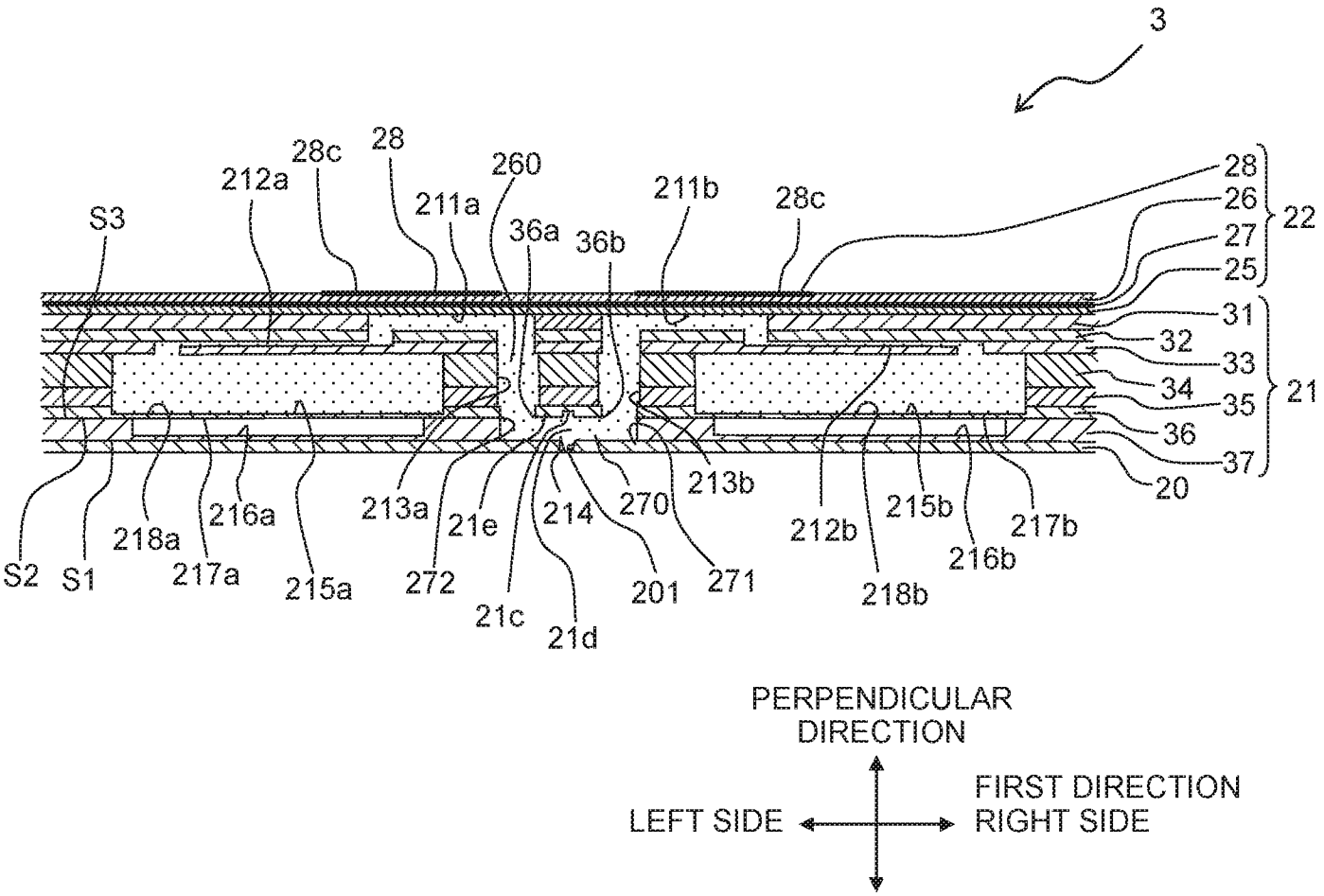
FIG. 4 is a cross-sectional view of FIG. 3 along the line IV-IV.

As depicted in FIG. 4, the channel unit 21 is constructed from a stacked body where seven plates 31 to 37 are stacked in layers along a direction perpendicular to the surface S1. The plates 31 to 37 are stacked in the numbering order in the orientation approaching the platen 4 along the direction perpendicular to the surface S1. The seven plates 31 to 37 in the stacked body are attached to each other with a thermosetting adhesive.

The plate 37 has the surface S1 against the nozzle plate 20, and the surface S3 against the plate 36. The plate 37 has through holes 270 formed therethrough in the plate-thickness direction to construct the channels 214. Openings 271 of the through holes 270 at the side of the nozzle plate 20 are covered by the nozzle plate 20. That is, the openings 271 define the contours of end portions of the channels 241 at the side of the nozzle plate 20.

The ink jet head 3 has the same number 72 of link channels 260 as that of nozzles 201. That is, the surface S1 of the plate 37 defines the same number 72 of openings 271 as that of nozzles 201.

The plate 36 has the surface S2 against the plate 37. The surface S2 is joined with the plate 37. The plate 36 is formed with the openings 36*a* and the openings 36*b*, each set of which has 72 members. The openings 36*a* serve as the boundaries between the descender channels 213*a*, and the channels 214 extending in a direction parallel to the surface S1. The openings 36*b* serve as the boundaries between the descender channels 213*b* and the channels 214.

The surface S2 defines the same number 72 of openings 36*a* as that of nozzles 201 and the same number 72 of openings 36*b* as that of nozzles 201. The openings 36*a* are at the surface S2 of the descender channels 213*a* while the openings 36*b* are at the surface S2 of the descender channels 213*b*. Further, the plate 36 has a plate portion 21*e*. The plate portion 21*e* is arranged between the openings 36*a* and the openings 36*b* in a first direction parallel to the surface S1.

Figure 2:
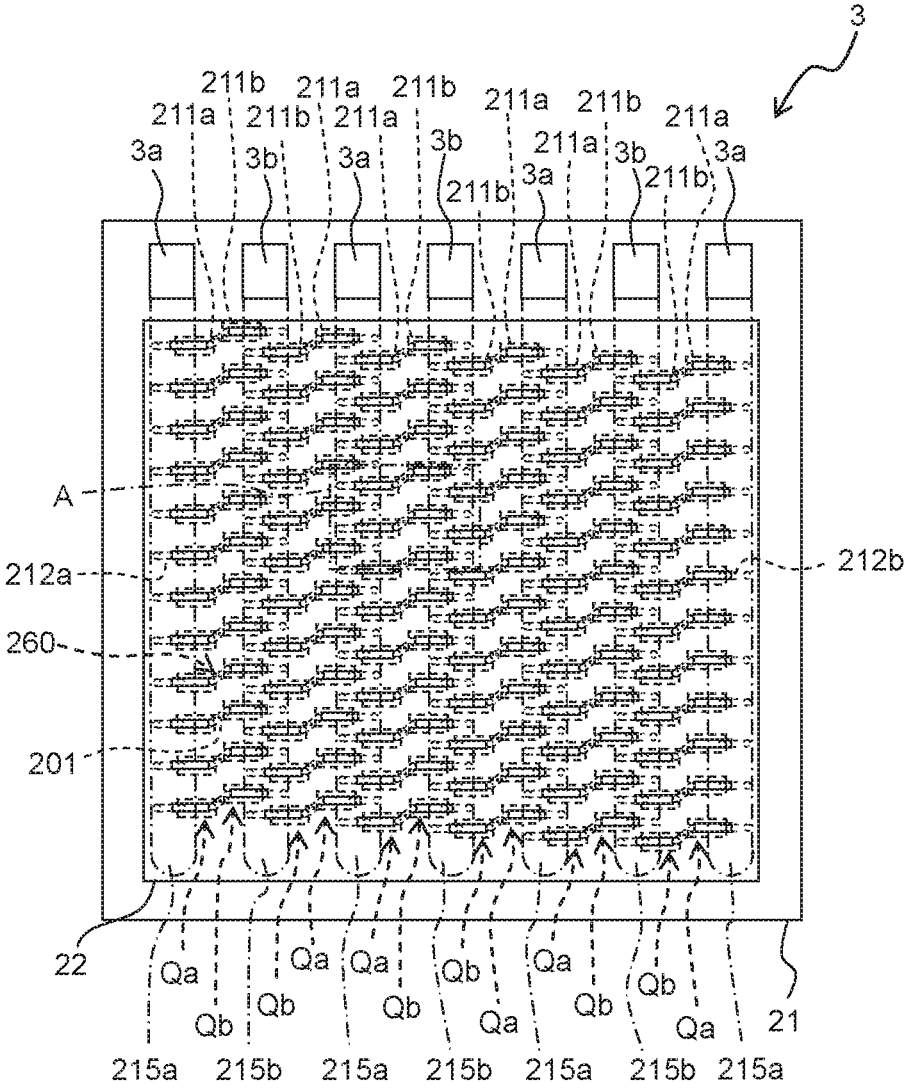
FIG. 2 is a plan view of an ink jet head in FIG. 1.
Figure 2:
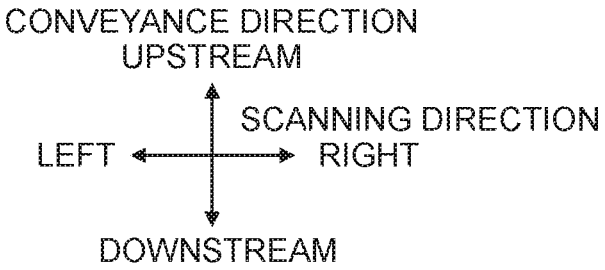
Figure 3:
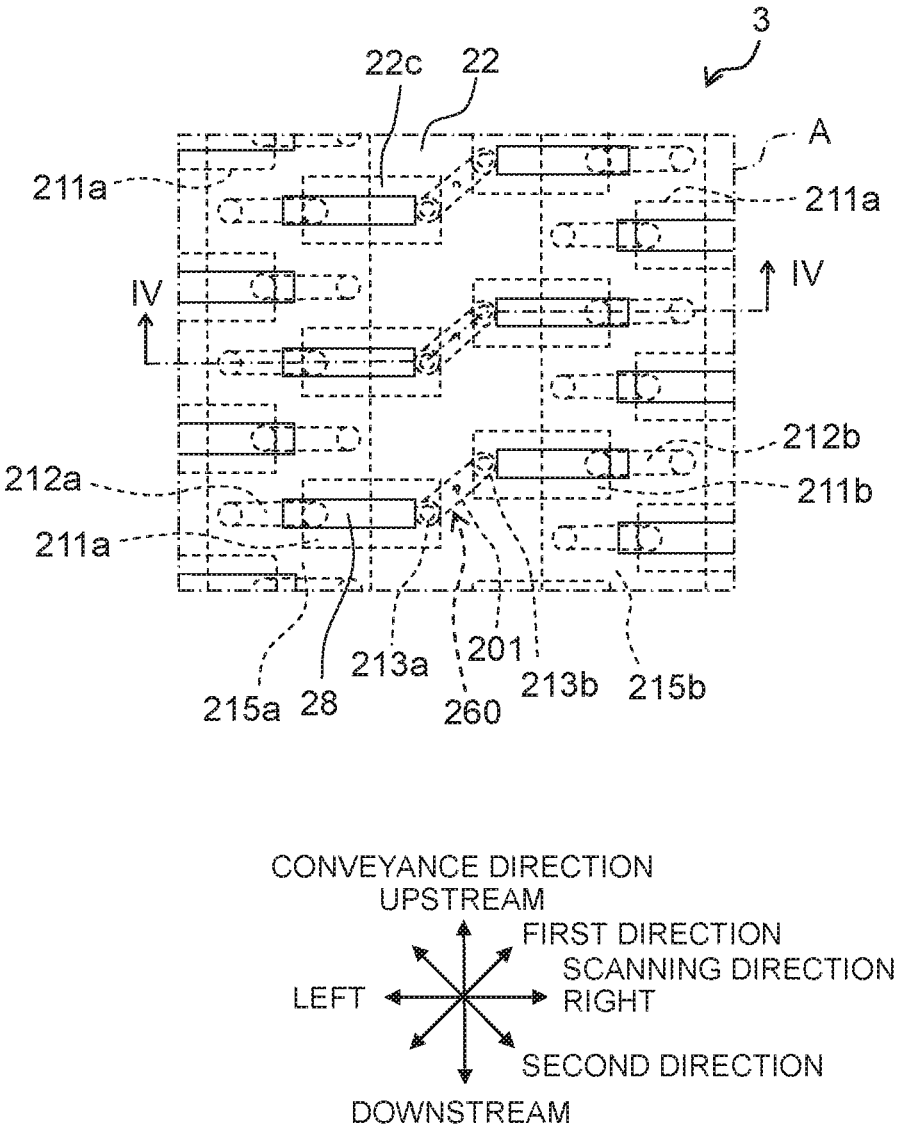
FIG. 3 is an enlarged view of a part enclosed with a chain line in FIG. 2.

As depicted in FIGS. 2 to 4, the plate 31 is formed with the pressure chambers 211*a* and the pressure chambers 211*b*, each set of which has 72 members. The pressure chambers 211*a* and 211*b* are shaped with the scanning direction and the first direction respectively as their longitudinal directions. As viewed from a direction perpendicular to the surface S1, the pressure chambers 211*a* and 211*b* are shaped in rectangles. The pressure chambers 211*a* and 211*b* extend along a plane parallel to the scanning direction and the conveyance direction, respectively.

The 72 pressure chambers 211*a* form 6 pressure chamber rows Qa. Each of the pressure chamber rows Qa includes 12 pressure chambers 211*a*. Further, the 72 pressure chambers 211*b* form 6 pressure chamber rows Qb. Each of the pressure chamber rows Qb includes 12 pressure chambers 211*b*. The 12 pressure chambers 211*a* belonging to each pressure chamber row Qa are arranged in the conveyance direction at a predetermined distance from each other. The 12 pressure chambers 211*b* belonging to each pressure chamber row Qb are arranged in the conveyance direction at a predetermined distance from each other.

The 6 pressure chamber rows Qa and the 6 pressure chamber rows Qb are arranged in the scanning direction. In particular, the 6 pressure chamber rows Qa and the 6 pressure chamber rows Qb are arranged, from left to right in the scanning direction, in the order of Qa, Qb, Qb, Qa, Qa, Qb, Qb, Qa, Qa, Qb, Qb, and Qa.

That is, except the two pressure chamber rows Qa at the left and right ends in the scanning direction, the pressure chamber rows Qa and the pressure chamber rows Qb are arranged in pairs successively in the scanning direction. In the adjacent pressure chamber rows Qa and pressure chamber rows Qb in the scanning direction, the pressure chambers 211*a* and 211*b* are shined from each other at a pitch in the conveyance direction.

The plates 32 to 36 define the four manifolds 215*a* and the three manifolds 215*b*. Each of the manifolds 215*a* extends in the conveyance direction, and one end thereof in the conveyance direction is connected to the supply port 3*a*. Further, each of the manifolds 215*b* also extends in the conveyance direction, and one end thereof along the conveyance direction is connected to the supply port 3*b*.

The four manifolds 215*a* and the three manifolds 215*b* are arranged in the scanning direction. In particular, the four manifolds 215*a* and the three manifolds 215*b* are arranged, from left to right along the scanning direction, in the order of 215*a*, 215*b*, 215*a*, 215*b*, 215*a*, 215*b*, and 215*a*.

The pressure chambers 211*a* are connected with the manifolds 215*a* through the throttle channels 212*a*. Further, the pressure chambers 211*b* are connected with the manifolds 215*b* through the throttle channels 212*b*. The pressure chamber 211*a* and the pressure chamber 211*b* are arranged along the first direction parallel to the surface S1. For example, each of the pressure chambers 211*a* and 211*b* has a certain cross-sectional area perpendicular to the first direction. Further, the cross-sectional areas of the pressure chambers 211*a* and 211*b* are identical.

As depicted in FIG. 4, each of the throttle channels 212*a* is formed to cross over a boundary between the plates 32 and 33. Further, the throttle channels 212*b* are also formed to cross over a boundary between the plates 32 and 33. The throttle channels 212*a* are provided individually for the pressure chambers 211*a*. Further, the throttle channels 212*b* are provided for the pressure chambers 211*b*.

The throttle channels 212*a* provided for the pressure chambers 211*a* forming the first pressure chamber row Qa from the left of the page of FIG. 2 respectively connect the left ends of the pressure chambers 211*a* forming the pressure chamber row Qa and the manifold 215*a* adjacent to the left side of the pressure chamber row Qa. Much the same is true as the first pressure chamber row Qa on the third pressure chamber row Qb, the fifth pressure chamber row Qa, the seventh pressure chamber row Qb, the ninth pressure chamber row Qa, and the eleventh pressure chamber row Qb, from the left of the page of FIG. 2. The throttle channels 212*b* provided for the pressure chambers 211*b* forming the second pressure chamber row Qb from the left of the page of FIG. 2 respectively connect the right ends of the pressure chambers 211*b* forming the pressure chamber row Qb and the manifold 215*b* adjacent to the right side of the pressure chamber row Qb. Much the same is true as the second pressure chamber row Qb on the fourth pressure chamber row Qa, the sixth pressure chamber row Qb, the eighth pressure chamber row Qa, the tenth pressure chamber row Qb, and the twelfth pressure chamber row Qa, from the left of the page of FIG. 2.

The descender channels 213*a* and 213*b* extend in a direction perpendicular to the surface S1, The respective descender channels 213*a* are formed of through holes formed in the respective plates 32 to 37 to overlap with each other in the direction perpendicular to the surface S1. The respective descender channels 213*b* are also formed of through holes formed in the respective plates 32 to 37 to overlap with each other in the direction perpendicular to the surface S1. The descender channels 213*a* are provided for the pressure chambers 211*a*. Further, the descender channels 213*b* are provided for the pressure chambers 211*b*.

The surface S3 of the plate 37 is formed with 72 openings 272. Each of the 72 openings 272 is in communication with one opening 36*a* formed in the plate 36 and one opening 36*b* formed in the plate 36. The surface S3 defines the openings 272. The openings 272 are openings of the through holes 270 formed in the plate 37 at the side of the plate 36. If a second direction is defined as orthogonal to the first direction and parallel to the surface S1, then the respective openings 272 are sized larger along the first direction than along the second direction.

The descender channels 213*a* provided for the pressure chambers 211*a* forming the first pressure chamber row Qa from the left of the page of FIG. 2 respectively connect the right ends of the pressure chambers 211*a* forming the pressure chamber row Qa and the corresponding channels 214 through the openings 36*a* and the openings 272. Much the same is true as the first pressure chamber row Qa on the third pressure chamber row Qb, the fifth pressure chamber row Qa, the seventh pressure chamber row Qb, the ninth pressure chamber row Qa, and the eleventh pressure chamber row Qb, from the left of the page of FIG. 2. The descender channels 213*b* provided for the pressure chambers 211*b* forming the second pressure chamber rows Qb from the left of the page of FIG. 2 respectively connect the left ends of the pressure chambers 211*b* forming the pressure chamber row and the corresponding channels 214 through the openings 36*b* and the openings 272. Much the same is true as the second pressure chamber row Qb on the fourth pressure chamber row Qa, the sixth pressure chamber row Qb, the eighth pressure chamber row Qa, the tenth pressure chamber row Qb, and the twelfth pressure chamber row Qa, from the left of the page of FIG. 2.

Figure 5:
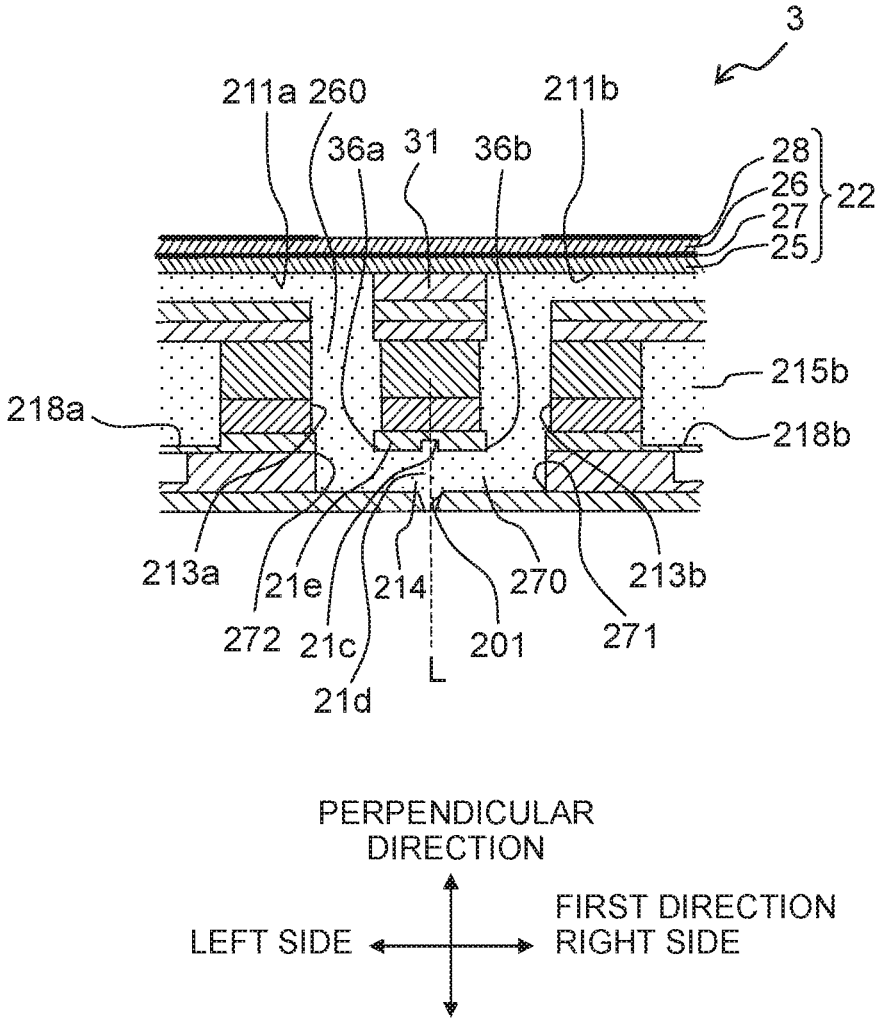
FIG. 5 is an enlarged view of FIG. 4.

As depicted in FIGS. 4 and 5, the channels 214 extend in the first direction to link the pressure chambers 211*a* and the pressure chambers 211*b*. In this embodiment, as viewed from the direction perpendicular to the surface S1, the channels 214 have a constant width from the position for the openings 36*a* to have the maximum diameter to the position for the openings 36*b* to have the maximum diameter.

Here, the channel unit 21 has a dent portion 21*c* formed in an inner wall defining the link channel 260 (the inner wall defining each channel 214 as one example). The dent portion 21*c* is formed in such a part as on an axis line L of the nozzle 201 to be dented in a direction away from the nozzle 201. In this embodiment, the dent portion 21*c* is dented to have a rectangle shape on a cross section orthogonal to the second direction.

The dent portion 21*c* is formed in a central portion of the channel 214 in the longitudinal direction (in other words, in the communication portion 21*d* in communication with the nozzle 201), by way of etching part of the surface of the plate 36. That is, the channel unit 21 has the plate 36 whose surface is formed with the dent portion 21*c* by way of partial etching.

The dent portion 21*c* has such a depth in the plate-thickness direction of the plate 36 (to be simply referred to below as "depth") as smaller than the plate-Thickness of the plate 36. In other words, the dent portion 21*c* is formed without penetrating through the plate 36. It is possible to set an appropriate depth for the dent portion 21*c* and, for example, the dent portion 21*c* is set to a value of being not larger than ½ of the plate thickness of the plate 36. The dent portion 21*c* is exposed to the inside of the channel 214.

The dent portion 21*c* has such a length in the first direction as smaller than the length of the channel 214 in the first direction. It is possible to set an appropriate length for the dent portion 21*c* in the first direction and, for example, the dent portion 21*c* is set to a value of being not larger than ½ of the length of the channel 214 in the first direction.

Further, in the first embodiment, as viewed from the axial direction of the nozzle 201, the maximum size of the dent portion 21*c* in the first direction is smaller than the inner diameter of the nozzle 201 at the upstream end in the jetting direction of the nozzle 201. Further, as viewed from the axial direction of the nozzle 201, the maximum size of the dent portion 21*c* is set to a value of being not larger than 70 μm in the first direction.

The dent portion 21*c* detains some air bubbles mixed in the ink flowing through the channel 214. With the dent portion 21*c* being set to the above value of the length in the first direction, the channel unit 21 detains air bubbles sized comparatively small. The dent portion 21*c* removes, from the ink, the air bubbles being smaller than a certain size mixed in the ink flowing through the channel 214.

The air bubbles detained in the dent portion 21*c* are discharged from the dent portion 21*c* by way of the controller 15 controlling at least one of the pumps P1 to P3 while pressurizing the ink inside the channel 214 to cause the same to flow therethrough. Because the dent portion 21*c* is sized very small in the first direction, the air bubbles detained in the dent portion 21*c* can be discharged from the dent portion 21*c* by driving the pumps P1 to P3 over a comparatively short time.

Further, as viewed form the direction perpendicular to the surface S1, the openings 36*a* and the openings 36*b* lie within the projections of the channels 214, respectively. Further, as viewed from the direction perpendicular to the surface S1, the maximum diameter of the openings 36*a* and the maximum diameter of the openings 36*b* are smaller than the width of the channels 214.

As depicted in FIGS. 2 to 4, the manifolds 215*a* and 215*b* are formed by overlapping, along the direction perpendicular to the surface S1, the through holes penetrating through the plates 34 and 35, with recesses 218*a* and recesses 218*b* formed in the surface of the plate 36 against the plate 35.

The four manifolds 215*a* are arranged at intervals in the scanning direction. Each of the four manifolds 215*a* extends in the conveyance direction. Further, the three manifolds 215*b* are also arranged at intervals in the scanning direction. Each of the three manifolds 215*b* also extends in the conveyance direction and arranged between two adjacent manifolds 215*a* in the scanning direction.

Due to the drives of the pumps P1 to P3, the ink flowing through the pipe 9 to supply the ink jet head 3 from the supply ports 3*a* is further supplied to the manifolds 215*a*. The ink supplied to the manifolds 215*a* from the supply ports 3*a* is further supplied to the throttle channels 212*a* and 212*b*.

Then, the ink is supplied to the manifolds 215*b* after flowing through and in the order of one of each pair of the throttle channels 212*a* and 212*b*, one of each pair of the descender channels 213*a* and 213*b*, the other of each pair of the descender channels 213*a* and 213*b*, and the other of each pair of the throttle channels 212*a* and 212*b*.

Further, due to the drives of the pumps P1 to P3, the ink supplied to the manifolds 215*b* is discharged to the pipe 9 from the supply ports 3*b*. The ink discharged from the supply ports 3*b* is returned to the negative pressure tank 12 through the pipe 9. By virtue of this, in this embodiment, the ink is circulated between the ink jet head 3 and the tanks 11 and 12.

The damper chambers 216*a* and 216*b* are formed in the plate 37. The damper chambers 216*a* are formed in positions overlapping with the manifolds 215*a* along the direction perpendicular to the surface S1, while the damper chambers 216*b* are formed in positions overlapping with the manifolds 215*b* along the direction perpendicular to the surface S1.

The damper chambers 216*a* are distanced from the manifolds 215*a* by partition walls 217*a* formed in the plate 36. The damper chambers 216*b* are distanced from the manifolds 215*b* by partition walls 217*b* formed in the plate 36. The damper chambers 216*a* and 216*b* allow the partition walls 217*a* and 217*b* to deform in the direction perpendicular to the surface S1. Due to the deformation of the partition walls 217*a* and 217*b*, the ink inside the manifolds 215*a* and 215*b* is restrained respectively from pressure variation.

<The Piezoelectric Elements>

The piezoelectric elements 22*c* apply a pressure to the ink flowing through the pressure chambers 211*a* and 211*b* to jet the ink from the nozzles 201. In the ink jet head 3, the 144 piezoelectric elements 22*c* are provided to correspond respectively to the 144 pressure chambers 211*a* and 211*b*.

As depicted in FIGS. 2 to 4, an actuator 22 is provided on the surface of the channel unit 21 on a side opposite to the nozzle plate 20. The actuator 22 is constructed from two piezoelectric layers 25 and 26, a common electrode 27, 144 individual electrodes 28, and a vibration plate, and has the 144 piezoelectric elements 22*c*. The piezoelectric layers 25 and 26 are formed of a piezoelectric material. For example, a piezoelectric material whose main component is lead zirconate titanate (PZT) may be used.

The piezoelectric layer 25 is arranged to superimpose the plate 31 of the channel unit 21 while the piezoelectric layer 26 is arranged to superimpose the piezoelectric layer 25. The piezoelectric layer 25 may be formed of a different material from the piezoelectric layer 26. In such a case, the piezoelectric layer 25 may be formed of, for example, an insulating material other than piezoelectric materials such as a synthetic resin material or the like.

The common electrode 27 is arranged between the piezoelectric layer 25 and the piezoelectric layer 26 to extend continuously throughout almost the entire area of the piezoelectric layers 25 and 26. The common electrode 27 is kept at the ground potential. The 144 individual electrodes 28 are provided individually for the total of 144 pressure chambers 211*a* and 211*b*.

As viewed from the direction perpendicular to the surface S1, the respective individual electrodes 28 have an approximately rectangular planar shape elongated in the scanning direction. The respective individual electrodes 28 are arranged to overlap with central positions of the corresponding pressure chambers 211*a* or 211*b* along an up/down direction. End portions of the respective individual electrodes 28 at the other side than the descender channels 213*a* or 213*b* along the scanning direction extend up to positions not overlapping with the pressure chambers 211*a* or 211*b*, and their leading ends serve as connecting terminals 28*c* for connection with a wiring member.

The connecting terminals 28*c* of the 144 individual electrodes 28 are connected to a predetermined driver IC via the wiring member The 144 individual electrodes 28 are set individually by the driver IC to either the ground potential or a predetermined drive potential (for example, 20 V or so). Further, by arranging the common electrode 27 and the 144 individual electrodes 28 in the above manner, such parts of the piezoelectric layer 26 as interposed between the individual electrodes 28 and the common electrode 27 function as active portions polarized in the direction perpendicular to the surface S1. Each of the piezoelectric elements 22*c* has an active portion polarized in the direction perpendicular to the surface S1.

In the piezoelectric elements 22*c*, all of the individual electrodes 28 are kept at the same ground potential as the common electrode 27 when the ink is not jetted from the nozzles 201 (in the standby state). Further, in the piezoelectric elements 22*c*, when the ink is jetted from a particular nozzle 201, the potential is switched to the predetermined drive potential applied to the two individual electrodes 28 corresponding to the pressure chamber 211*a* and the pressure chamber 211*b* connected to that particular nozzle 201.

Thereafter, such an electrical field arises as parallel to the polarization direction of the two piezoelectric elements 22*c* corresponding to the above two individual electrodes 28, such that the above two piezoelectric elements 22*c* contract in a horizontal direction orthogonal to the polarization direction of the above two piezoelectric elements 22*c*. By virtue of this, in the two piezoelectric elements 22*c*, such parts of the piezoelectric layers 25 and 26 as overlapping with the respective pressure chambers 211*a* and 211*b* along the up/down direction deform to project as a whole toward the pressure chambers 211*a* and 211*b*.

As a result, the volumes of the pressure chambers 211*a* and 211*b* decrease such that the ink pressure in the pressure chambers 211*a* and 211*b* increases, thereby jetting the ink from the particular nozzle 201. After the ink is jetted, the potential of the above two individual electrodes 28 returns to the ground potential. By virtue of this, the piezoelectric layers 25 and 26 are restored to the state before the deformation.

Here, in the first embodiment, the controller 15 causes the piezoelectric elements 22*c*, which correspond to the nozzles 201 not jetting the ink among the 72 nozzles 201, to deform in a backward move from the pressure chambers 211*a* and 211*b* corresponding to those nozzles 201. That is, the parts of the piezoelectric layers 25 and 26 overlapping with the respective pressure chambers 211*a* and 211*b* in the up/down direction deform to project as a whole in a direction away from the pressure chambers 211*a* and 211*b*.

When driving the printer 1, among the 72 nozzles 201 formed in the nozzle plate 20, it is possible to carry out printing on the recording sheet M by jetting the ink only from specified nozzles 201. In such cases, the 72 nozzles 201 include those jetting the ink and those not jetting the ink. By way of such backward deformation of the piezoelectric elements 22*c* corresponding to the nozzles 201 not jetting the ink as from the pressure chambers 211*a* and 211*b* corresponding to those nozzles 201. the ink is restrained from being jetted from the nozzles 201 not being scheduled to jet the ink.

As explained above, according to the ink jet head 3, if air bubbles are mixed into a fluid flowing through the channel 214, it is possible to detain the air bubbles in the dent portion 21*c*. Because the dent portion 21*c* is formed in the part overlapping with the axis line L of the nozzle 201, a balance is maintained for the pressure applied to the ink in the pressure chamber 211*a* and the pressure chamber 211*b*. By detaining the air bubbles in the dent portion 21*c*, it is possible to prevent unstable operation of jetting the ink from the nozzle 201 due to the air bubbles mixed in the circulating ink.

Further, the air bubbles detained in the dent portion 21*c* can be discharged from the dent portion 21*c* by pressurizing and circulating the ink when the ink is not jetted from the nozzle 201, for example. By virtue of this, it is possible to preferably eliminate the air bubbles mixed in the circulating ink from the periphery of the nozzle 201 before carrying out the operation of jetting the ink. Further, because the air bubbles need not be eliminated when the ink is jetted from the nozzle 201, it is possible to prevent an increase in the load on the ink jet head 3 for eliminating the air bubbles.

Further, if comparatively large air bubbles are detained in the channel 214 so as not to fit in the dent portion 21*c*, then it is possible to cause impediment to a normal ink flow and adhesion of the ink. To address this problem, in the ink jet head 3, such comparatively large air bubbles are eliminated from the channel 214 along with the ink flow independently from the dent portion 21*c*. Therefore, it is possible to prevent such problem from occurring.

Further, on the cross section orthogonal to the second direction, because the dent portion 21*c* is dented to have the shape of a rectangle, it is easy to detain the air bubbles mixed in the ink flowing through the channel 214 in the first direction, in a corner portion inside the dent portion 21*c*. Hence, it is possible to efficiently detain the air bubbles in the dent portion 21*c*.

Further, as viewed from the axial direction of the nozzle 201, the maximum size of the dent portion 21*c* along the first direction is smaller than the inner diameter of the nozzle 201 at the upstream end along the jetting direction. Therefore, it is possible to preferably detain the comparatively small air bubbles in the dent portion 21*c*.

Further, as viewed from the axial direction of the nozzle 201, the maximum size of the dent portion 21*c* along the first direction is set to a value not larger than 70 μm. Therefore, it is possible to preferably detain the air bubbles sized not larger than 70 μm in the dent portion 21*c*.

Further, the channel unit 21 has the plate 36, and the dent portion 21*c* is formed in the surface of the plate 36 by way of the partial etching. It is possible to arrange the dent portion 21*c* easily inside the channel 214 by using such kind of plate 36.

The channel unit 21 is formed with the manifold 215*a* connected to the pressure chamber 211*a* and the manifold 215*b* connected to the pressure chamber 211*b*. Further, while the plate 36 is provided with the dent portion 21*c*, the recess 218*a* and the recess 218*b* are provided respectively in the part facing the manifolds 215*a* and 215*b*.

In this manner, if one plate 36 is provided with the dent portion 21*c* and the recesses 218*a* and 218*b*, then for example, by processing a plurality of areas of the plate 36, it is possible to efficiently form the dent portion 21*c* and the recess 218*a* and 218*b*.

Further, the dent portion 21*c* and the recesses 218*a* and 218*b* may be formed simultaneously by way of the partial etching of the plurality of areas in the plate 36. Therefore, through the one etching process, it is possible to efficiently form the dent portion 21*c* and the recesses 218*a* and 218*b*.

Note that the recesses 218*a* and 218*b* may be provided in the same surface as that provided with the dent portion 21*c* of the plate 36. With that, through an etching process of the same surface of the plate 36, it is possible to efficiently form the dent portion 21*c* and the recesses 218*a* and 218*b* at one time.

Further, the controller 15 causes the piezoelectric elements 22*c*, which correspond to the nozzles 201 not jetting the ink among the 72 nozzles 201, to deform in the backward move from the pressure chambers 211*a* and 211*b* corresponding to those nozzles 201. Therefore, when the controller 15 drives the pumps P1 to P3 to eliminate the air bubbles from the dent portion 21*c*, it is possible to prevent the ink from being mistakenly jetted from the nozzles 201 which are not scheduled to jet the ink.

In the above description, the surface S1 corresponds to the first surface, the manifold 215*a* corresponds to the first manifold, and the manifold 215*b* corresponds to the second manifold. Further, the recess 218*a* corresponds to the first recess, and the recess 218*b* corresponds to the second recess. Further, the pressure chambers 211*a* correspond to the first pressure chamber, and the pressure chambers 211*b* correspond to the second pressure chamber.

Modified Embodiments

Figure 6:
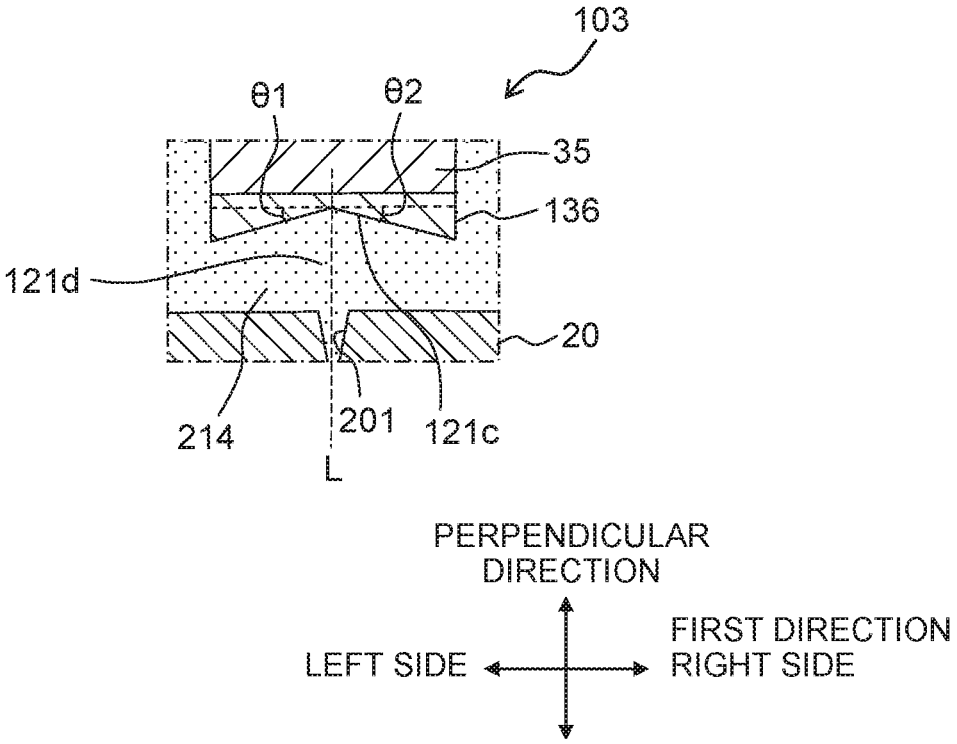
FIG. 6 is an enlarged cross-sectional view of an ink jet head according to a modified example of the first embodiment.

Hereinbelow, explanation will he made on a few modified embodiments and other embodiments, focusing on the difference from the first embodiment. As depicted in FIG. 6, in a plate 136 of an ink jet head 103, in a cross section orthogonal to the second direction, a dent portion 121*c* is dented to have a wedge shape tapering in a direction away from the nozzle 201. In other words, as viewed from the second direction, the dent portion 121*c* is dented to assume a triangle whose one vertex is located at a communication portion 121*d*. In the ink jet head 103 having such kind of the dent portion 121*c*, the same effect is also exerted as the ink jet head 3.

Further, the dent portion 121*c* has a symmetrical shape with respect to the nozzle axis direction of the nozzle 201 on the cross section orthogonal to the second direction. However, it may have a nonsymmetrical shape.

For example, as viewed on the cross section orthogonal to the second direction, the inclination angle θ1 of the surface at the side of the openings 36*a* to a surface S1 may differ from the inclination angle θ2 of the surface at the side of the openings 36*b* to the surface S1. In such a case, the angle θ2 may be larger than the θ1. For example, the angle θ2 may have a value two times the angle θ1 or more or a value three times the angle θ1.

Second Embodiment

Figure 7:
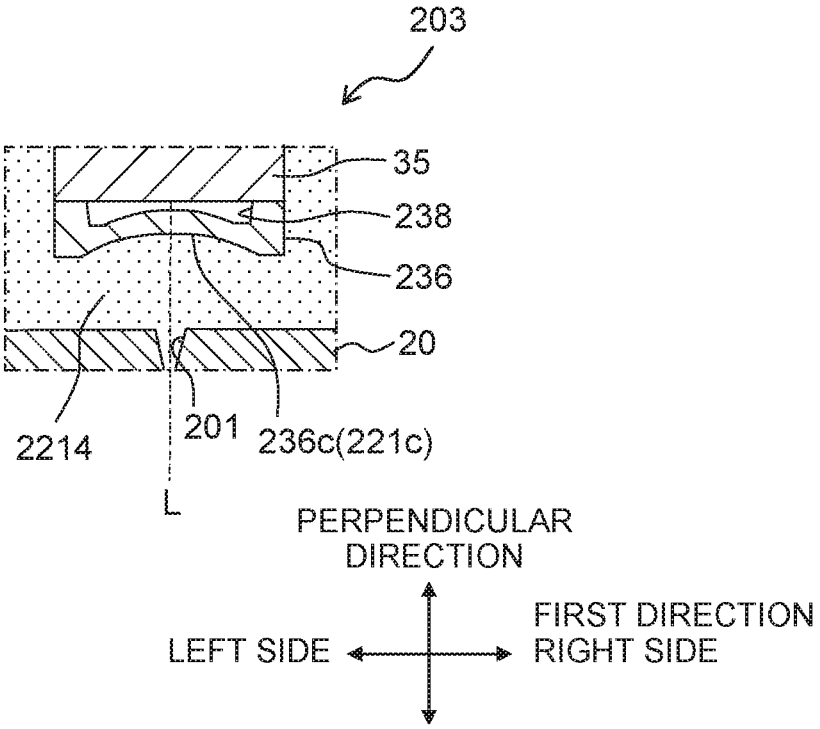
FIG. 7 is a cross-sectional view of an ink jet head according to a second embodiment of the present teaching.

As depicted in FIG. 7, a thin portion 236*c* may be formed in a plate 236 being closest to a channel 2214 among the seven plates of the channel unit. The thin portion 236*c* is formed in a part, of the plate 236, overlapping with the axis line L of the nozzle 201. Further, a recess may be formed to construct an airtight chamber 238 in such a position of the plate 236 on a side opposite to the channel 2214 with respect to the thin portion 236*c*. The airtight chamber 238 is provided in contact with the thin portion 236*c*. In the ink jet head 203, with the thin portion 236*c* dented toward the airtight chamber 238, a dent portion 221*c* is provided in the plate 236 being closest to the channel 2214.

In particular, the thin portion 236*c* is formed by partially etching the surface of the plate 236 at the other side than the channel 2214. Further, the airtight chamber 238 is provided to overlap with the thin portion 236*c* between the plate 236, and the plate 35 adjacent to the plate 236.

Here, the seven plates of the stacked body of the channel unit are, as described earlier on, attached to each other with a thermosetting adhesive. By virtue of this, along with the cooling after heating adhesion of the seven plates, the inner pressure of the airtight chamber 238 is lower than that of the channel 2214. As a result, the ink jet head 203 is formed with the dent portion 221*c*.

In the second embodiment, the controller 15 drives the pumps P1 to P3 to change the fluid pressure inside the channel 2214, so as to deform the thin portion 236*c* in the stacking direction of the seven plates (the direction perpendicular to the surface S1).

In particular, the controller 15 drives the pumps P1 to P3 to pressurize the ink flowing though the channel 2214, so as to raise the fluid pressure inside the channel 2214 to be higher than the inner pressure of the airtight chamber 238. By virtue of this, the thin portion 236*c* is dented toward the airtight chamber 238 to form the dent portion 221*c*.

Further, the controller 15 drives the pumps P1 to P3 to make the fluid pressure of the channel 2214 to be lower than the inner pressure of the airtight chamber 238, thereby reducing the depth of the dent portion 221*c*. By virtue of this, the air bubbles detained in the dent portion 221*c* are discharged from the dent portion 221*c*. in this manner, in the ink jet head 203 having the dent portion 221*c* of such kind, the same effect is also exerted as the ink jet head 3.

The present teaching is not limited to the above embodiments but, without departing from the true scope and the spirit of the present teaching, its configuration may be changed, supplemented, and/or deleted.

In the above manner, the present teaching has an excellent effect in enabling prevention of unstable operation of jetting a liquid from the nozzles due to the air bubbles mixed in the liquid, in a liquid jetting apparatus including two pressure chambers. Therefore, it is beneficial to widely apply the present teaching to liquid jetting apparatuses capable of fulfilling the significance of the effect.

What is claimed is:

1. A liquid jetting apparatus comprising:

a nozzle plate having a nozzle; and a channel unit joined with the nozzle plate, wherein the channel unit is formed with: a first pressure chamber; a second pressure chamber; and a link channel linking the first pressure chamber and the second pressure chamber, and wherein in the channel unit, a dent portion is formed on an inner wall, which defines the link channel, at a part overlapping with an axis line of the nozzle, the dent portion being dented in a direction away from the nozzle, and wherein the dent portion and the inner wall of the link channel form a first edge and a second edge, the dent portion being interposed between the first edge and the second edge.

2. The liquid jetting apparatus according to claim 1, wherein the channel unit has a first surface facing the nozzle plate, wherein the first pressure chamber and the second pressure chamber are arranged in a first direction parallel to the first surface, and wherein as viewed from a second direction which is parallel to the first surface and orthogonal to the first direction, the dent portion has a cross section orthogonal to the second direction dented in a rectangle shape.

3. The liquid jetting apparatus according to claim 1, wherein the channel unit has a first surface facing the nozzle plate, wherein the first pressure chamber and the second pressure chamber are arranged in a first direction parallel to the first surface, and wherein as viewed from a second direction which is parallel to the first surface and orthogonal to the first direction, the dent portion has a cross section orthogonal to the second direction dented in a wedge shape tapering in a direction away from the nozzle.

4. The liquid jetting apparatus according to claim 1, wherein the channel unit has a first surface facing the nozzle plate, and wherein as viewed from a direction along the axis line of the nozzle, the maximum size of the dent portion in a first direction parallel to the first surface is smaller than an inner diameter, of the nozzle, at an upstream end in a jetting direction in which liquid is jetted from the nozzle.

5. The liquid jetting apparatus according to claim 1, wherein the channel unit has a first surface facing the nozzle plate, and wherein as viewed from a direction along the axis line of the nozzle, the maximum size of the dent portion in a first direction parallel to the first surface is equal to or smaller than 70 μm.

6. The liquid jetting apparatus according to claim 1, further comprising:

piezoelectric elements provided to correspond respectively to the first pressure chamber and the second pressure chamber, the piezoelectric elements being configured to apply pressure to liquid flowing through the first pressure chamber and the second pressure chamber to jet the liquid from the nozzle; and a controller configured to control the piezoelectric elements, wherein in a case where the liquid is not jetted from the nozzle, the controller is configured to cause the piezoelectric elements to deform to project in a direction away from the first pressure chamber and the second pressure chamber.

7. The liquid jetting apparatus according to claim 1, wherein the channel unit has a plate having a surface in which the dent portion is formed.

8. The liquid jetting apparatus according to claim 7, wherein the channel unit is further formed with: a first manifold in communication with the first pressure chamber; and a second manifold in communication with the second pressure chamber, and wherein the plate having the dent portion is formed with: a first recess defining the first manifold; and a second recess defining the second manifold.

9. The liquid jetting apparatus according to claim 1, wherein the channel unit has a first surface facing the nozzle plate, wherein the channel unit is constructed of a stacked body in which plates are stacked in a direction perpendicular to the first surface, wherein in a closest plate closest to the link channel among the plates, a thin portion is formed in a part positioned on the axis line of the nozzle, the thin portion being thinner in plate thickness than a periphery of the part, an airtight chamber is defined by the thin portion on a side opposite to the link channel with respect to the thin portion, and the dent portion is formed in the closest plate by the thin portion being dented toward the airtight chamber.

10. The liquid jetting apparatus according to claim 9, wherein the thin portion is formed by partially etching a surface, of the closest plate, on the side opposite to the link channel, and wherein the airtight chamber is formed to overlap with the thin portion between the closest plate and an adjacent plate which is included in the plates and adjacent to the closest plate.

11. The liquid jetting apparatus according to claim 9, wherein the plates in the stacked body are attached to each other with a thermosetting adhesive.

12. A liquid jetting system comprising:

the liquid jetting apparatus as defined in claim 9;

a pump causing liquid to flow into the first pressure chamber and the second pressure chamber; and a controller configured to control the pump, wherein the controller is configured to drive the pump to change a fluid pressure inside the link channel and thereby deform the thin portion in a stacking direction of the plates.

* * * * *